US005579096A

United States Patent [19]

Saito et al.

[11] Patent Number: 5,579,096

[45] Date of Patent: Nov. 26, 1996

[54] IMAGING APPARATUS AND METHOD FOR CLEANING TRANSFER/CONVEYER MEANS

[75] Inventors: Yousuke Saito; Takao Umeda; Masayasu Anzai; Hiroyuki Mabuchi; Yasuo Kikuchi; Masato Miwa; Takashi Suzuki, all of Ibaraki, Japan

[73] Assignee: Hitachi Koki Co., Ltd., Tokyo, Japan

[21] Appl. No.: 498,125

[22] Filed: Jul. 5, 1995

[30] Foreign Application Priority Data

Jul. 5, 1994 [JP] Japan ..... 6-153816

[51] Int. Cl.[6] ..... G03G 15/14

[52] U.S. Cl. ..... 355/271

[58] Field of Search ..... 355/271, 273, 355/274

[56] References Cited

U.S. PATENT DOCUMENTS 5,198,863 3/1993 Goto et al. ..... 355/271 X 5,453,822 9/1995 Anzai et al. ..... 355/271

*Primary Examiner*—William J. Royer

*Attorney, Agent, or Firm*—Sughrue, Mion, Zinn, Macpeak & Seas

[57] ABSTRACT

An imaging apparatus such that residual toner on a transfer/conveyer mechanism such as a transfer belt and an intermediate transfer material is effectively removable. High-tension voltage opposite in magnetic polarity (plus) to the charged toner and a photosensitive drum is applied to a discharger 15 provided ahead of a drive member 12 for driving a transfer belt 6. The residual toner on the transfer belt 6 is removed by a brush 21, and the residual foreign substances come in contact with the photosensitive drum 1 and move onto the photosensitive drum 1 before a printing operation is started. The foreign substances are then removed by a photosensitive drum cleaner.

6 Claims, 8 Drawing Sheets

Q ; CHARGED QUANTITY OF TONER
F1 ; FORCE OF ADHERING TO BELT
F2 ; MECHANICAL FORCE OF BRUSH
F3 ; ELECTROSTATIC FORCE OF BRUSH

IMAGING APPARATUS AND METHOD FOR CLEANING TRANSFER/CONVEYER MEANS

BACKGROUND OF THE INVENTION

1. Field of the Invention

The present invention relates generally to imaging apparatus for developing electrostatic latent images to visualize the same in such devices as copying machines, laser printers and the like, and more particularly to an imaging apparatus having a transfer belt as a transfer/conveyer means for conveying a transfer material such as transfer paper and transferring a toner image formed on an image carrier onto the transfer material, and to a method for cleaning the transfer/conveyer means.

2. Description of the Related Art

Some of the transcription apparatus utilizing electrophotography employ a system using a dielectric belt and an insulating drum constituting a transfer/conveyer means for conveying a transfer material such as transfer paper and transferring a toner image onto the transfer paper. A cleaning mechanism is then required in the following cases:

(1) When a toner image is transferred onto a transfer/conveyer means:

In a case where transfer paper which is being conveyed stops because of jamming or mechanical trouble and-fails to reach a transcription unit, a toner image formed on a photosensitive drum may be transferred not onto the transfer paper but onto a transfer/conveyer means directly. This arises from the fact that when the apparatus detects jamming or mechanical trouble and makes a control unit issue a halt instruction, the toner image on the photosensitive drum is allowed to reach the transcription unit before current is actually stopped from being supplied to the photosensitive drum, a drive motor as the transfer/conveyer means, and a transcriber.

When characters are printed on the (front, rear, left-or right-hand) edge portion of the transfer paper, moreover, the transfer paper may be conveyed to the transcription unit as it slips out of position in relation to paper running accuracy. In this case, such a toner image is left in an outside portion close to the outer edge of the transfer paper.

(2) When fogging toner is transferred:

In a case where transfer paper whose width is smaller than that of transfer/conveyer means is used, no latent image is formed in a region where the transfer paper is not fed (where the belt does not contact the paper). However, the toner may stick to the background portion (the fogging phenomenon) and the fogging toner in that non-paper running region is transferred to the transfer/conveyer means.

In addition, there is produced a space between sheets of paper when cut transfer paper is used. As in the non-paper running case, the fogging toner is transferred to the transfer/conveyer means as it is generated in the paper-to-paper space.

(3) When paper dust sticks to the transfer/conveyer means:

The friction between transfer paper and rollers or the like in the conveyer system causes surface fibers to rub against the roller, thus producing paper dust. If the paper dust continues to stick to the transfer/conveyer means and is heavily accumulated, the adhesion of the transfer paper to the transfer/conveyer means will lower, which will also cause drum wrapping (a phenomenon in which the paper is attracted to the photosensitive drum side and rolled in thereon).

A method for removing the dust comprises the steps of facilitating the removal of foreign substances sticking to the transfer/conveyer means by pretreatment with a corona charger and subsequently removing toner, using a blade of urethane or the like or a conductive brush to which bias opposite in magnetic polarity to the toner has been applied.

As such a blade is used to remove foreign substances by pressing its leading edge portion, the leading edge will wear off if it is used for a long time; its cleaning performance is thus lowered. In the case of a conductive brush, its cleaning performance will also be lowered because bristles tend to fall down or foreign substances are accumulated in the clearances of the bristles as it is continuously used.

When the cleaning performance of the transfer/conveyer means lowers, it is impossible to clean out a toner image sticking to the transfer/conveyer means. Then the residual toner will adhere to the back of the transfer paper subsequently fed, thus soiling the back of the transfer paper and deteriorating printing quality. Moreover, the lowered adhesion of the transfer paper to the transfer/conveyer means causes trouble such as the aforementioned drum wrapping.

SUMMARY OF THE INVENTION

The present invention has been made to obviate the drawbacks of the prior art, and an object of the invention is to provide an imaging apparatus having a transcription unit capable of maintaining the cleaning performance of transfer/conveyer means even when the performance of cleaning members such as a blade and a brush has deteriorated and a method for cleaning the transfer/conveyer means.

In order to accomplish the object above, an imaging apparatus in the first aspect of the invention comprises: an image carrier such as a photosensitive drum for carrying a toner image, transfer/conveyer means such as a transfer belt for conveying a transfer material such as transfer paper so as to press the transfer paper against part of the image carrier, and a transcriber installed on the opposite side of the image-carrier-side of the transfer/conveyer means and used for transferring the toner image onto the transfer material in a transcription unit.

Further, a corona discharger, for example, as charge furnishing means for providing deposits sticking to the transfer/conveyer means with electric charges opposite in polarity to those on the surface of the image carrier is provided, on the downstream side of the transcription unit, in the direction in which the transfer/conveyer means is moved, and close to the transfer/conveyer means, and cleaning means for removing deposits from the transfer/conveyer means is provided, on the downstream side of the charge furnishing means, in the direction in which the transfer/conveyer means is moved; more specifically, the cleaning means including:

a cleaning member such as a blade or a brush which makes contact with the transfer/conveyer means and is used for removing deposits, joining-disjoining means such as an electromagnetic plunger for joining the image carrier and the transfer/conveyer means together and disjoining the latter from the former, the image carrier charged opposite in magnetic polarity to the deposits sticking to the transfer/conveyer means, and deposit removing means such as a photosensitive drum cleaner for removing deposits sticking to the image carrier.

The joining-disjoining means makes part of the transfer/conveyer means cleaned by the cleaning member contact the image carrier so as to transfer the residual deposits on the transfer/ conveyer means to the image carrier, and the deposit removing means removes the deposits thus transferred.

In order to accomplish the object above, a method for cleaning the transfer/conveyer means of an imaging apparatus in the second aspect of the invention, the imaging apparatus comprising an image carrier for carrying a toner image, transfer/conveyer means for conveying a transfer material so as to press the transfer material against part of the image carrier, and a transcriber installed on the opposite side of the image-carrier-side of the transfer/conveyer means and used for transferring the toner image onto the transfer material in a transcription unit.

The method therefore comprises the steps of furnishing deposits sticking to the transfer/conveyer means with charges opposite in polarity to those on the surface of the image carrier, using charge furnishing means provided, on the downstream side of the transcription unit, in the direction in which the transfer/conveyer means is moved, removing the deposits furnished with the charges, using a cleaning member in contact with the transfer/conveyer means, transferring the deposits which remain unremoved by the cleaning member to the image carrier, and removing the deposits transferred to the image carrier, using deposit removing means.

As set forth above, according to the present invention, the adhesion of the deposits (toner, paper dust and the like) sticking to the transfer/conveyer means is lowered by the charge furnishing means, so that the deposits are readily removed by the cleaning member.

Moreover, the deposits remaining unremoved by the cleaning member are transferred to the image carrier before being removed by the deposit removing means, whereby image quality is improved without causing the back of transfer paper to be soiled because the transfer/conveyer means is effectively cleaned and because the clean condition is maintainable for a long period of time.

DESCRIPTION OF THE PREFERRED EMBODIMENTS

Figure 1:
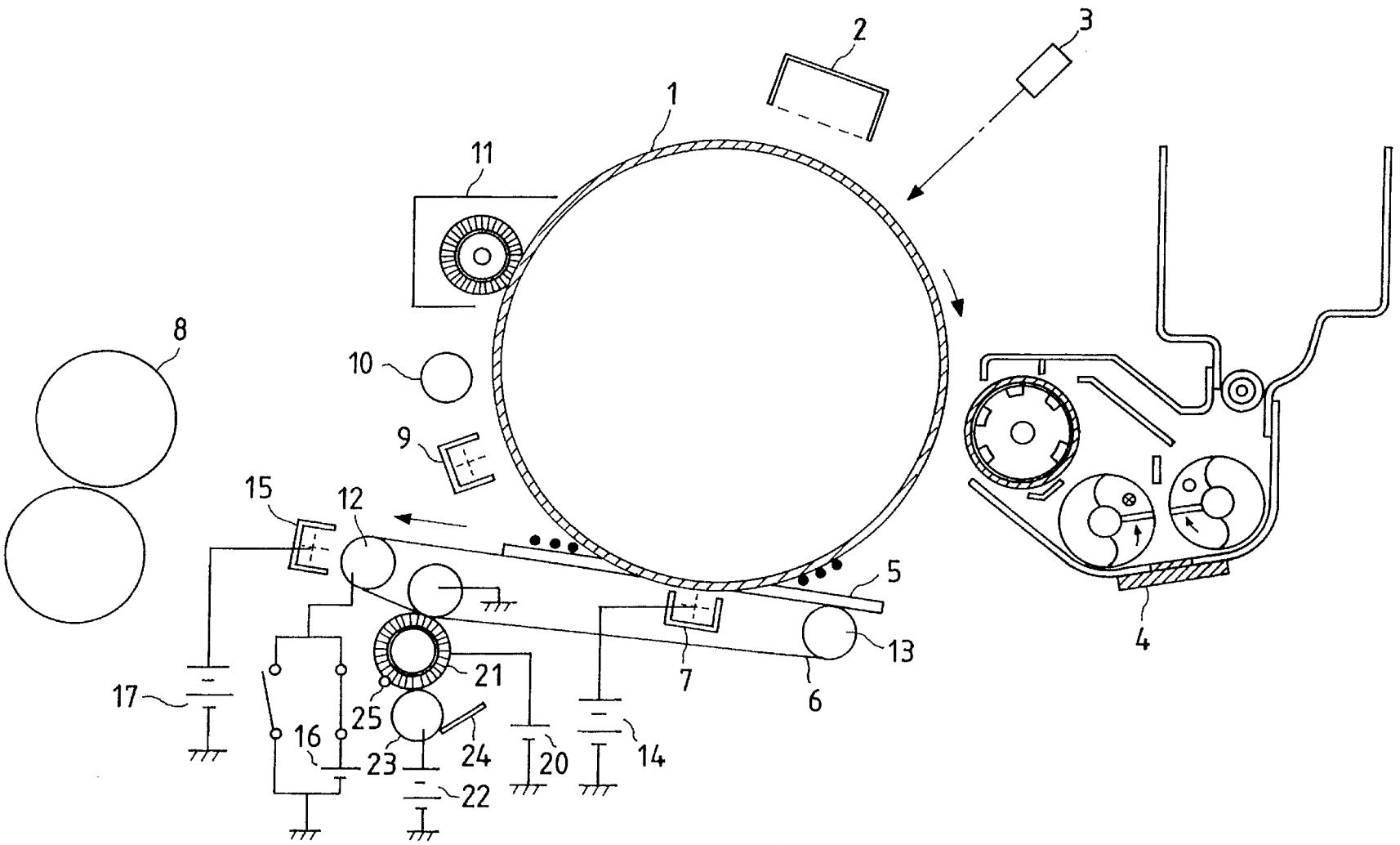
FIG. 1 is a schematic diagram of an imaging apparatus embodying the present invention with a detailed illustration of a transfer unit.

Referring to the drawings, the preferred embodiments of the present invention will subsequently be described.

(Embodiment 1)

Referring to FIG. 1, a description will be given of a case where an imaging apparatus embodying the present invention is applied to a laser printer using electrophotography in which minus toner is employed so as to form an image by reversal development.

A photosensitive drum 1 constitutes an image carrier, and its surface is uniformly charged through the glow discharge of a charger 2. Then a light source 3 such as a semiconductor laser, a LED or the like causes a latent image to be formed on the photosensitive drum 1, and a developer 4 makes toner stick to the photosensitive drum 1.

Transfer paper 5 as a material to be transferred is first conveyed by a transfer belt 6 which is a dielectric having a transfer paper conveying function together with a transcribing function and then reaches a transcription unit where a toner image on the photosensitive drum 1 is transferred by a transcriber 7 onto the transfer paper 5. Further, the image on the transfer paper 5 is fixed by a fixing roller 8, and the toner image left on the photosensitive drum 1 is removed by a photosensitive drum cleaner 11 via a precharger 9 and an erase lamp 10. The next processing step is followed then.

The transfer belt 6 is held by a drive member 12 and a driven member 13, these members being driven by a motor (not shown) ahead of the former in the direction of an arrow. A high-tension power supply 14 is connected to the transcriber 7, so that a high voltage (4–7 KV) opposite in magnetic polarity (plus) to the toner is applied thereto. To the transfer paper 5 conveyed by the transfer belt 6, the toner image on the photosensitive drum 1 is transferred by the transcriber 7 in the transcription unit where the transfer belt 6 and the photosensitive drum 1 are kept in contact with each other. The transfer paper 5 is subsequently striped off the transfer belt 6. However, there arises a phenomenon in which the toner scatters because of the peeling discharge produced then, thus contaminating the inside of the apparatus.

In order to prevent the occurrence of such a phenomenon, voltages of as high as 4–7 KV and 500–2,000 V opposite in magnetic polarity (plus) to the toner are each applied from high-tension power supplies 16, 17 to the drive member 12 and a discharger 15. In other words, electric charges opposite in magnetic polarity to the toner are applied to the back of the transfer paper 5 to prevent the toner from scattering.

As will be described later, the high-tension power supply 16 operating to apply high voltage to the drive member 12 is set switchable; high voltage is normally applied thereto.

The transfer belt 6 usually requires no cleaning except for a case where a toner image has been transferred onto the transfer belt 6 for some reason.

Now referring to FIGS. 2 through 11 inclusive, a mechanism for cleaning out the transfer belt 6 in this practice of the invention will be described in detail.

Figure 2:
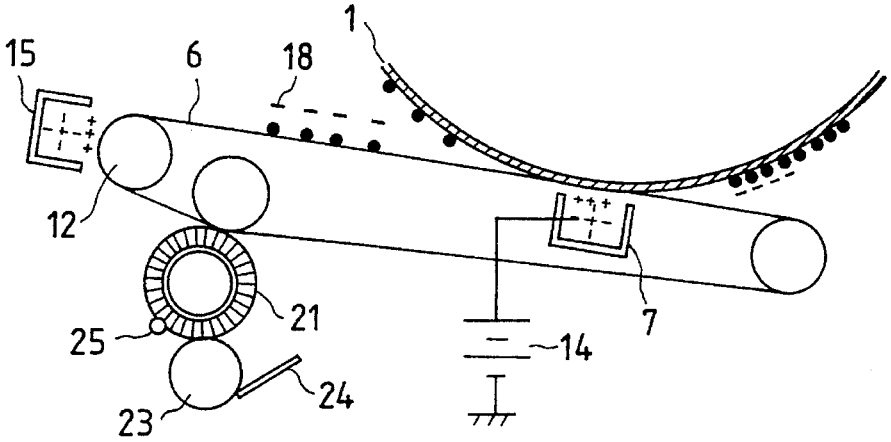
FIG. 2 is a diagram illustrating a mechanism for cleaning out a transfer belt by removing residual deposits according to the present invention.
Figure 3:
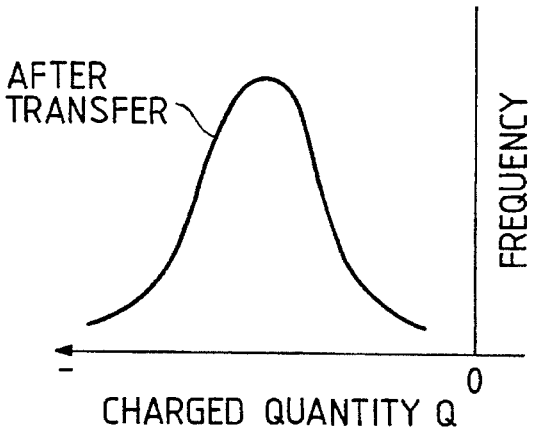
FIG. 3 is a graph illustrating a distribution of charged quantities of the toner according to the present invention.

(1) As long as a toner image 18 that has been transferred onto the transfer belt 6 because of jamming or mechanical trouble is concerned, the voltage applied by the high-tension power supply 14 to the transfer belt 6 is opposite in polarity (plus) to the voltage applied to the toner as shown in FIG. 2. Accordingly, the distribution of charged quantities of the toner exhibits a substantially uniform polarity (minus) as shown in FIG. 3. The mean charged quantity is in the range of −10 to −30 μC/g, though it varies with the toner used and the printer condition.

Figure 4:
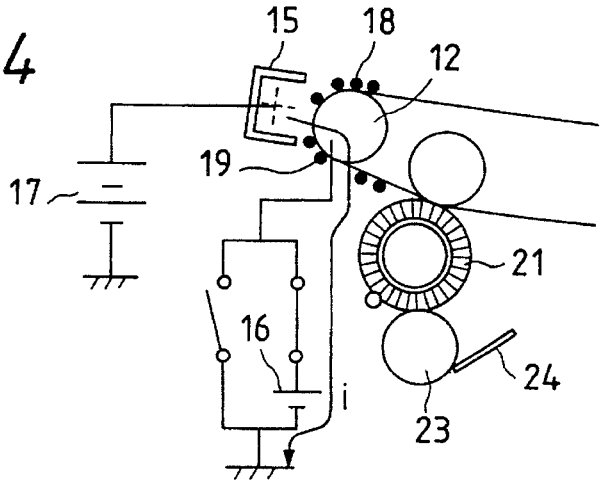
FIG. 4 is a diagram illustrating a mechanism for cleaning out the transfer belt by removing the residual deposits according to the present invention.
Figure 5:
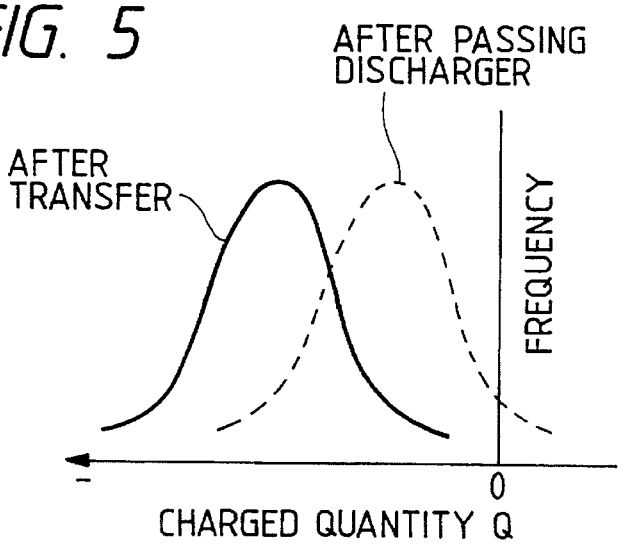
FIG. 5 is a graph illustrating the distribution of charged quantities of the toner after passing the discharger according to the present invention.

(2) As the high-tension power supply 16 is made to apply the high voltage opposite in magnetic polarity (plus) to the toner to the discharger 15 provided close to the drive member 12, a plus current i is caused to flow into the drive member 12 thus provided opposite thereto as shown in FIG. 4. With respect to the toner 19 that has passed by the discharger 15, the current iallowed to flow in makes the charged quantity change from the actual line to a dotted one of FIG. 5 and the mean charged quantities are distributed over the range of −2 to 10 μC/g, part of which is charged positively.

Figure 6:
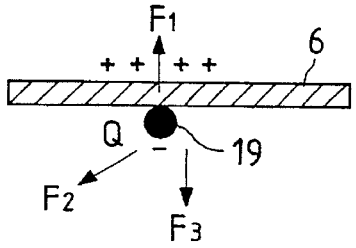
FIG. 6 is a force diagram illustrating the forces acting on the toner with respect to the transfer belt according to the present invention.

As forces F1, F2, F3 then act on the toner 19 on the transfer belt 6 as shown in FIG. 6, the charged quantity of the toner 19 decreases, and the force F1 of adhering to the transfer belt 6 is reduced accordingly.

Figure 7:
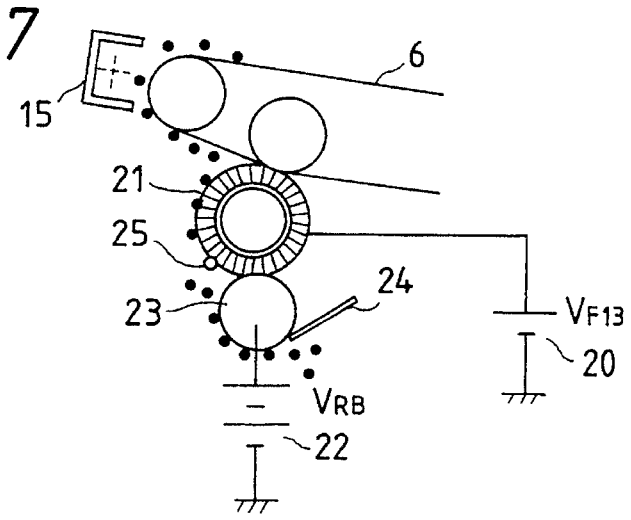
FIG. 7 is a diagram illustrating a mechanism for cleaning out the transfer belt by removing the residual deposits according to the present invention.

(3) The toner 19 whose force F1 of adhering to the transfer belt 6 has lowered is, as shown in FIG. 7, scraped mechanically and electrostatically by a brush 21 to which a plus bias voltage $V_{RB}$ has been applied by a bias power supply 20. Further, the toner 19 is moved to a recovery roll 23 to which a high bias voltage $V_{RB}$ has been applied by a bias power supply 22, so that it is scraped by a blade 24. A flicker bar 25 is used for knocking off the toner caked on the brush 21. The cleaning performance of the brush 21 is maximized when the mean charged quantity of the toner after its has passed by the discharger 15 is in the range of −3 to −6 μC/g.

In the case where the cleaning members such as the brush 21 and the blade 24 have not deteriorated yet as both are in the initial stage of use, almost the whole residue may be removed. However, such toner will hardly be removable completely if what is in small particle diameters exists in an extremely small quantity. When the cleaning members such as the brush 21 and the blade 24 have deteriorated, moreover, the toner is impossible to remove and will naturally remain on the transfer belt 6.

The residual deposits of toner are removed as follows:

(4) The residual deposits are caused to turn positive in polarity by the current i allowed to flow in from the discharger 15 via the drive member 12 (turn positive by rotation several times unless the deposits turn positive by rotation once). Since the plus bias voltage $V_{RB}$ has been applied to the brush 21, however, the residual deposits of toner which remain mechanically unremovable are not removed and moved into the transcription unit while the deposits are sticking to the transfer belt 6.

Figure 8:
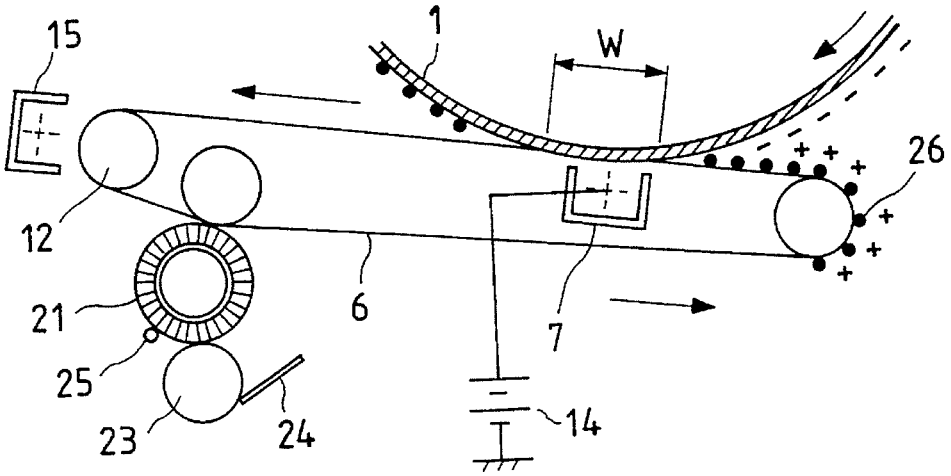
FIG. 8 is a diagram illustrating a mechanism for cleaning out the transfer belt by removing the residual deposits according to the present invention.

The transfer belt 6 keeps in contact with the photosensitive drum 1 with a constant nip width of W therebetween as shown in FIG. 8. Consequently, the positively-charged toner 26 is moved onto the negatively-charged photosensitive drum 1 in the transcription unit before being ultimately removed by the photosensitive drum 1 (see FIG. 1). Although the operation of the discharger 15 is preferably conditioned so that the cleaning step above is taken at the time the usual printing operation is performed, it may also be taken at the time the printing operation is not performed (e.g., at the time the recovery operation is performed or before the printing operation is terminated).

In this case, the drive member 12 is grounded, and the value of the current made to flow in from the discharger 15 is set greater during the process of removing the residual deposits by means of the brush 21 than the value at which the deposits are transferred to the photosensitive drum 1.

When toner sticking to the transfer belt 6 because of jamming or mechanical trouble results in suspending the operation of the apparatus, a measure is taken to remove the toner before the recovery operation is performed in such a state that the transfer belt 6 is kept noncontacting the photosensitive drum 1; this is intended to remove the toner image left on the photosensitive drum 1 and the transfer belt 6 because of jamming or mechanical trouble, and the each mechanism is driven to see if there is any abnormality in each process until the following printing operation is performed.

Figures 9A, 9B, 9C, 9D, 9E, 9F, 9G, 9H:
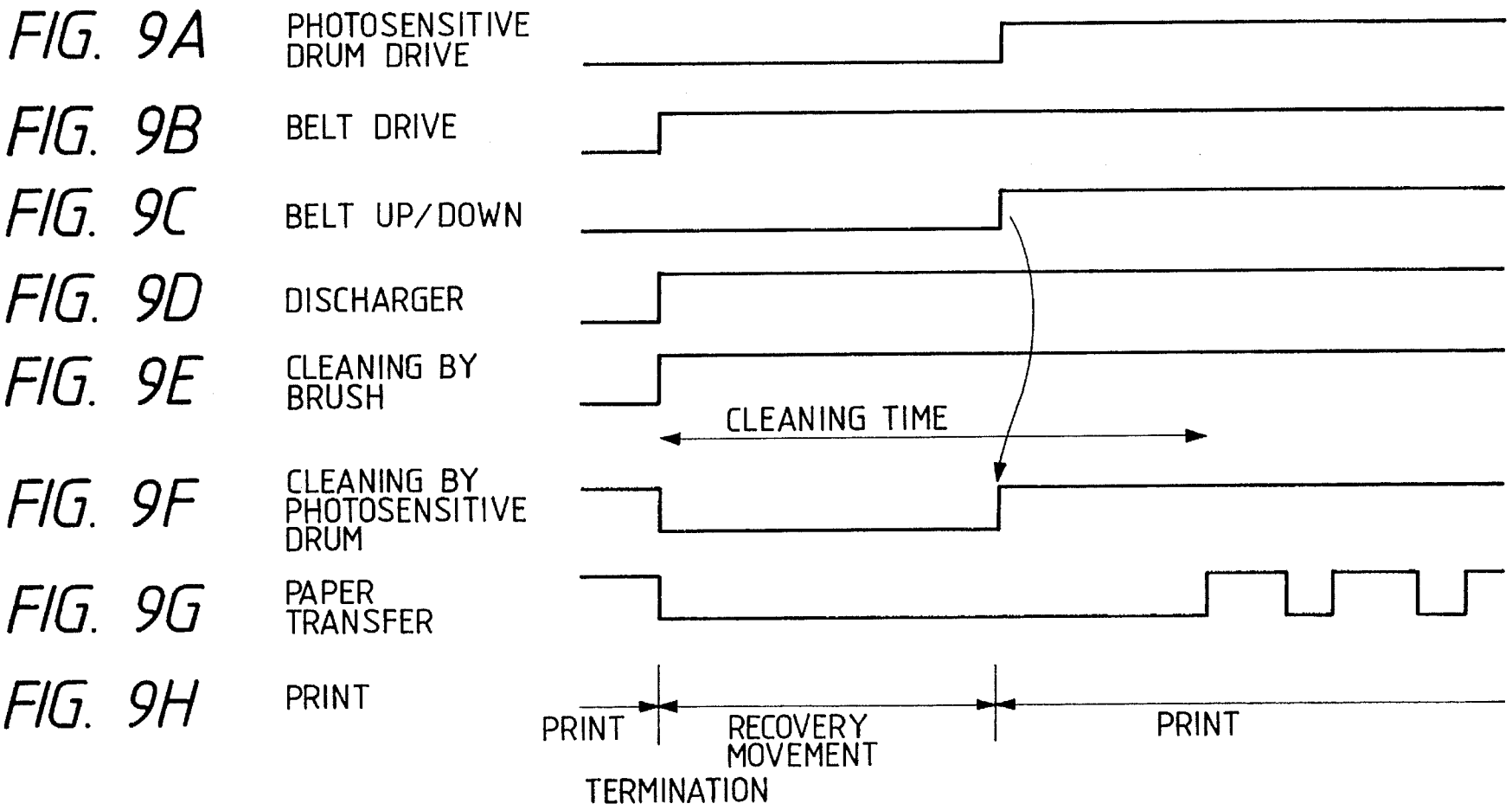
FIGS. 9A to 9H are sequence timing charts according to Embodiment 1 of the present invention.

FIGS. 9A to 9H show the sequences of cleaning the transfer belt 6. The cleaning operation shown in FIG. 9F is performed by the photosensitive drum 1 until transfer paper is fed after the cleaning operation shown in FIG. 9E is started by means of the brush. Before the cleaning operation shown in FIG. 9F is performed by the photosensitive drum 1, it is necessary to make the transfer belt 6 and the photosensitive drum 1 contact each other by moving up/down the transfer belt 6 as shown in FIG. 9C.

Figure 10:
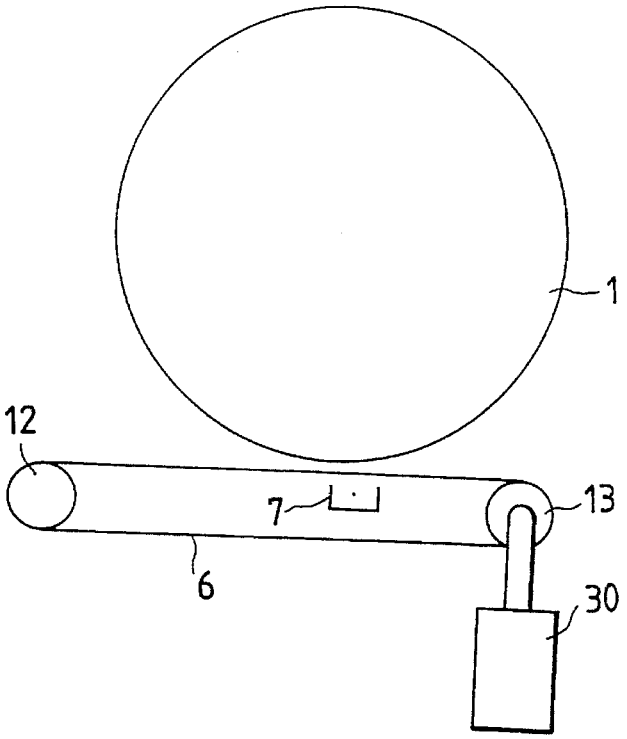
FIG. 10 is a schematic diagram illustrating the up/down operation of the transfer belt.
Figure 11:
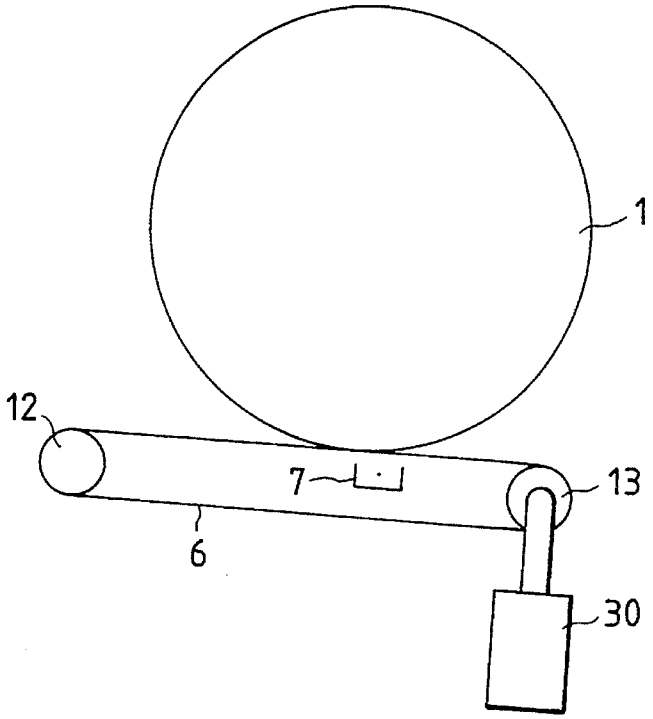
FIG. 11 is a schematic block diagram illustrating the up/down operation of the transfer belt.

FIGS. 10 and 11 illustrate the operation of moving up/down the transfer belt 6, wherein the transfer belt 6 is kept stretching between the drive member 12 and the driven member 13, and an electromagnetic plunger 30 is connected to the driven member 13.

While no power is supplied to the electromagnetic plunger 30, the transfer belt 6 is slightly separated from the photosensitive drum 1 as shown in FIG. 10. When power is supplied to the electromagnetic plunger 30, the transfer belt 6 together with the transcriber 7 slightly turns counterclockwise round the drive member 12 to contact the photosensitive drum 1.

Figure 12:
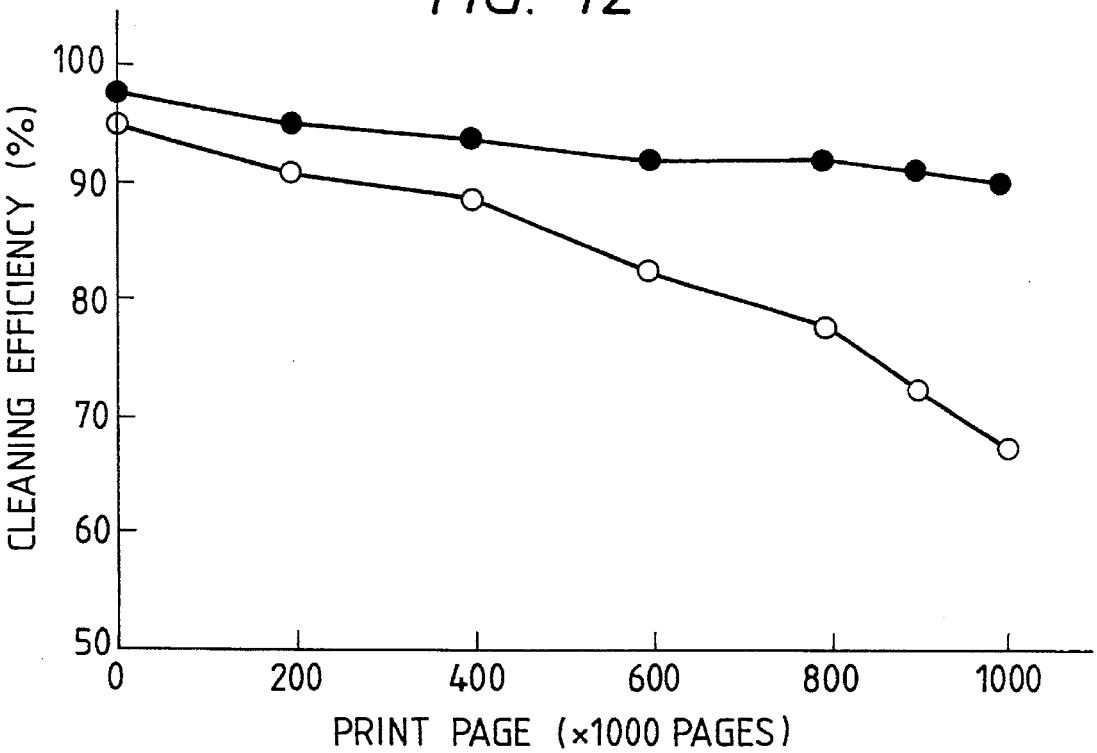
FIG. 12 is a characteristic diagram showing cleaning test results.

FIG. 12 is a characteristic diagram showing cleaning efficiency when cleaning tests are carried out in sequence. A curve with 0 marks in FIG. 12 represents a case where only the brush is used for cleaning purposes, whereas a curve with marks represents a case where the cleaning operation is performed by the photosensitive drum simultaneously after the cleaning operation is started by means of the brush.

In this case, the residual toner on the transfer belt 6 is peeled off with an adhesive tape in order to calculate cleaning efficiency η from the reflective concentration on the basis of the following equation:

$$\eta = D1/(D1 - D0)$$

where η: cleaning efficiency;

D1: reflective concentration after cleaning; and

D0: reflective concentration before cleaning.

As shown by 0 marks, the cleaning efficiency η becomes lowered when only the brush 21 is used because it wears off as the number of printing pages increases. On the other hand, the cleaning efficiency is maintained at over 90% even in the case of 1,000,000 printing pages when the photosensitive drum is employed for cleaning purposes after the brush is used therefor as shown by a curve with marks. Therefore, the back of transfer paper is made free from any inconvenience such as soiling since the transfer belt 6 has been cleaned.

Embodiment 2

Figures 13A, 13B, 13C, 13D, 13E, 13F, 13G, 13H:
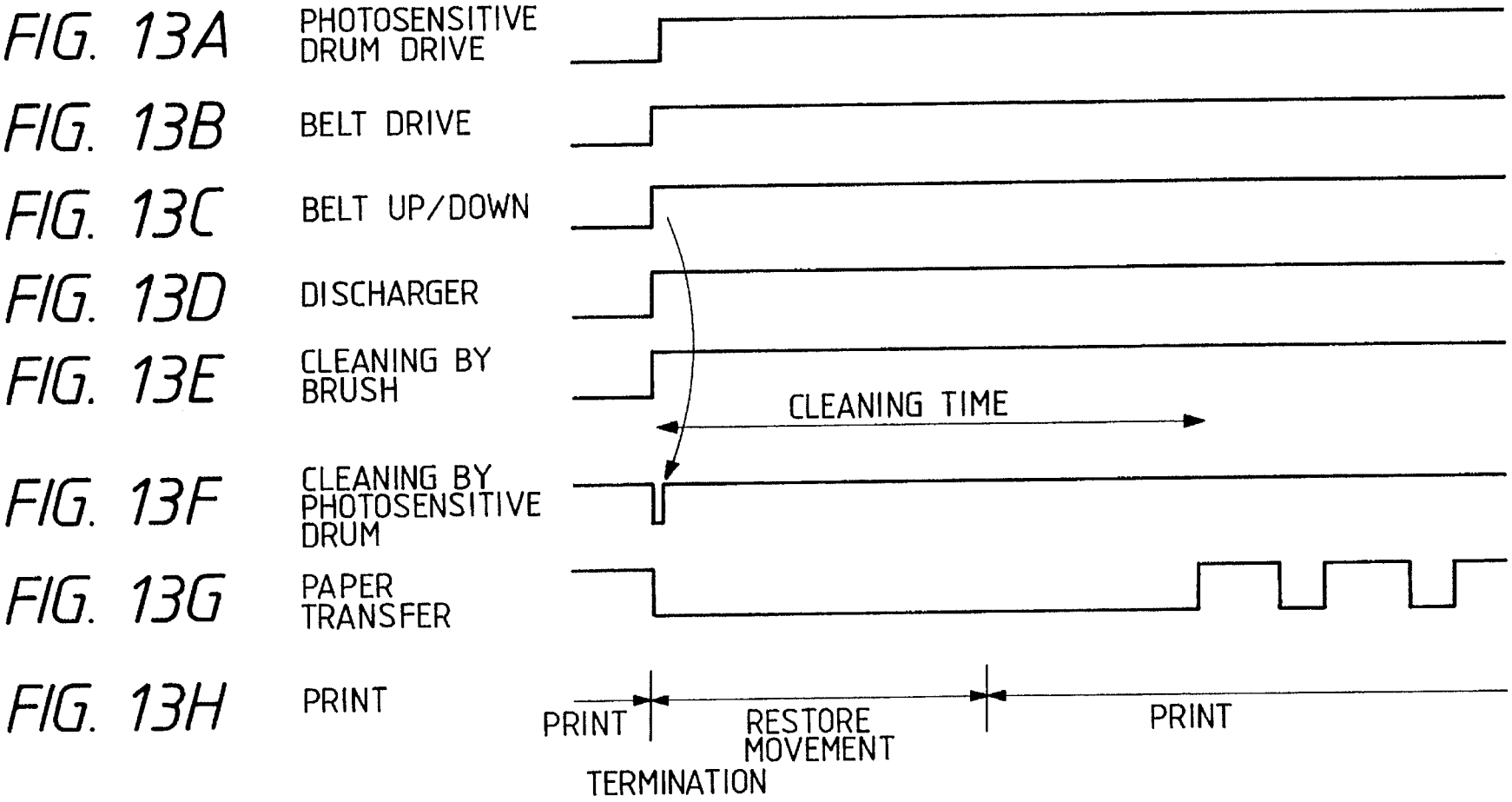
FIGS. 13A to 13H are sequence timing charts according to Embodiment 2 of the present invention.

In Embodiment 2, cleaning operations shown in FIGS. 13E and 13F are each performed simultaneously by the brush 21 and photosensitive drum 1 as a cleaning sequence at the time of recovery operation.

More specifically, while the transfer belt 6 and the photosensitive drum 1 are kept in contact with each other, both are driven at the time of the recovery operation (see FIG. 13H). At this time, the charger 2, the precharger 9, the erase lamp 10, the photosensitive drum cleaner 11 and the discharger 15 are kept in the start condition, whereas the steps of exposure and development are held stationary. Since the cleaning operations shown in FIGS. 13E and 13F are thus performed simultaneously by the brush 21 and the photosensitive drum 1, the transfer belt 6 can be cleaned in a short time. This means the cleaning operations shown in FIGS. 13E and 13F are each performed by the brush 21 and the photosensitive drum 1 simultaneously at all times during the printing operation.

Embodiment 3

Figures 14A, 14B, 14C, 14D, 14E, 14F, 14G, 14H, 14I:
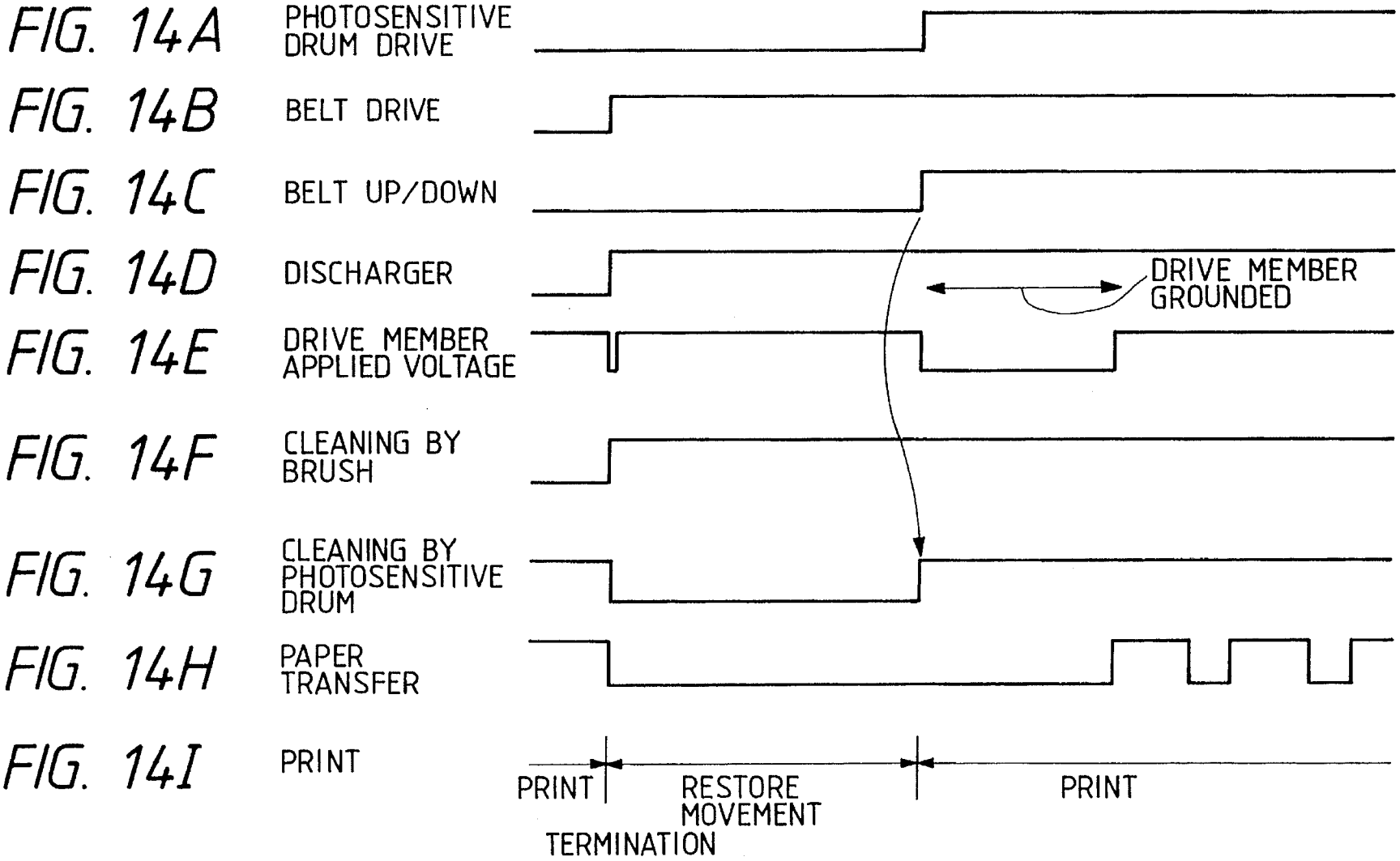
FIGS. 14A to 14I are sequence timing charts according to Embodiment 3 of the present invention.

In Embodiment 3, the current i allowed to flow into the drive member 12 from the discharger 15 is increased when the photosensitive drum 1 is used to perform a cleaning operation shown in FIG. 14G after the brush 21 has started the cleaning operation shown in FIG. 14F. At this time, the mean charged quantity of toner after its passage by the discharger 15 should be set at −3 to +15 μC/g, preferably +2 to +10 μC/g.

Since the high-tension power supply 16 of the drive member 12 is switchable as stated previously, the drive member 12 is grounded at the time of cleaning operation shown in FIG. 14G after the operation shown in FIG. 14F is performed by the brush 21 (see FIG. 14E).

Hence, more current is caused to flow through the residual deposits on the transfer belt 6 from the discharger 15, whereby the deposits can sufficiently be charged opposite in polarity (plus) to the surface potential of the photosensitive drum 1. As a result, the force of moving the residual deposits from the transfer belt 6 to the photosensitive drum 1 grows greater in the transcription unit, and the cleaning performance of the photosensitive drum 1 can be increased during the cleaning operation shown in FIG. 14G.

Although the conductive brush has been used as a cleaning member in the aforementioned embodiments of the present invention, not only the brush but also a blade, for example, may be employed.

As set forth above, according to the present invention, the residual toner on the surface of the transfer/conveyer means is removed by the brush and also by transposition to the image carrier. Therefore, the cleaning effect is greater than what is attainable by removing residual deposits in the conventional methods using a blade or a brush. Further, not only the life but also reliability of such an imaging apparatus is improvable.

What is claimed is:

1. An imaging apparatus comprising:

an image carrier for carrying a toner image;

transfer/conveyer means for conveying a transfer material so as to press the transfer material against part of the image carrier;

a transcriber installed on the opposite side of the image-carrier-side of said transfer/conveyer means and used for transferring the toner image onto the transfer material in a transcription unit;

charge furnishing means for providing deposits sticking to said transfer/conveyer means with electric charges opposite in polarity to those on the surface of the image carrier, said charge furnishing means being provided, on the downstream side of the transcription unit, in the direction in which said transfer/conveyer means is moved, and close to said transfer/conveyer means; and cleaning means for removing deposits from transfer/conveyer means, said cleaning means being provided on the downstream side of said charge furnishing means, in the direction in which said transfer/conveyer means is moved, wherein said cleaning means comprises:

a cleaning member which makes contact with said transfer/conveyer means and is used for removing the deposits; and means for joining the image carrier and said transfer/conveyer means together and disjoining the transfer/conveyer means from the image carrier, the image carrier being charged opposite in magnetic polarity to the deposits sticking to said transfer/conveyer means, and deposit removing means for removing deposits sticking to the image carrier;

wherein said joining and disjoining means makes part of the transfer/conveyer means cleaned by said cleaning member contact the image carrier so as to transfer the residual deposits on said transfer/conveyer means to the image carrier; and said deposit removing means removes the deposits thus transferred.

2. A method for cleaning the transfer/conveyer means of an imaging apparatus, the imaging apparatus comprising an image carrier for carrying a toner image, transfer/conveyer means for conveying a transfer material so as to press the transfer material against part of the image carrier, and a transcriber installed on the opposite side of the image-carrier-side of said transfer/conveyer means and used for transferring the toner image onto the transfer material in a transcription unit, said method comprising the steps of:

furnishing deposits sticking to said transfer/conveyer means with charges opposite in polarity to those on the surface of the image carrier, using charge furnishing means provided, on the downstream side of the transcription unit, in the direction in which said transfer/conveyer means is moved;

removing the deposits furnished with the charges, using a cleaning member in contact with said transfer/conveyer means;

transferring the deposits which remain unremoved by said cleaning member to the image carrier; and removing the deposits transferred to the image carrier, using deposit removing means.

3. A method for cleaning the transfer/conveyer means of an imaging apparatus as claimed in claim 2, wherein said transferring step is taken after said removing step has been taken by said cleaning member.

4. A method for cleaning the transfer/conveyer means of an imaging apparatus as claimed in claim 2, wherein said removing step which is performed by means of the cleaning member and said transferring step are taken simultaneously.

5. A method for cleaning the transfer/conveyer means of an imaging apparatus as claimed in claim 2, wherein said charge furnishing means is a corona charger and wherein said transfer/conveyer means includes a drive means, said drive means of said transfer/conveyer means being arranged opposite to the corona charger with said transfer/conveyer means held therebetween; and the value of a current caused to flow in toward said drive means from the corona charger is set greater during the process of removing the deposits by means of the cleaning member than the value at which the deposits are transferred to the image carrier.

6. A method for cleaning the transfer/conveyer means of an imaging apparatus as claimed in claim 5, wherein said drive means is grounded during the process of transferring the deposits to the image carrier.

* * * * *